US006578220B1

(12) United States Patent
Smith

(10) Patent No.: US 6,578,220 B1
(45) Date of Patent: Jun. 17, 2003

(54) MATTRESS ASSEMBLY

(76) Inventor: Earl J. Smith, P.O. Box 56, Cedarfalls, NC (US) 27230

( * ) Notice: Subject to any disclaimer, the term of this patent is extended or adjusted under 35 U.S.C. 154(b) by 0 days.

(21) Appl. No.: 10/095,823

(22) Filed: Mar. 13, 2002

(51) Int. Cl.[7] ..... A47C 27/15
(52) U.S. Cl. ..... 5/740; 5/738
(58) Field of Search ..... 5/740, 738, 727, 5/736, 690, 655.9

(56) References Cited

U.S. PATENT DOCUMENTS 3,939,508 A * 2/1976 Hall et al. ..... 5/740
4,580,301 A * 4/1986 Ludman et al. ..... 5/727
4,673,452 A * 6/1987 Awdhan ..... 5/740
5,960,496 A * 10/1999 Boyd ..... 5/740
6,212,720 B1 * 4/2001 Antinori et al. ..... 5/740
6,237,173 B1 * 5/2001 Schlichter et al. ..... 5/740
6,269,504 B1 * 8/2001 Romano et al. ..... 5/740

FOREIGN PATENT DOCUMENTS

AU 321200 * 9/1957 ..... 5/738
DE G 8809029.9 * 2/1989 ..... 5/690

* cited by examiner

*Primary Examiner*—Alex Grosz

(57) ABSTRACT

A mattress assembly for providing a more restful and supportive nights sleep to a user. The mattress assembly includes a mattress core assembly and a support member that has a generally planar base having an upper surface for supporting the mattress core assembly. The mattress core assembly is positioned on the upper surface of the base.

1 Claim, 2 Drawing Sheets

MATTRESS ASSEMBLY

BACKGROUND OF THE INVENTION

1. Field of the Invention

The present invention relates to mattresses and more particularly pertains to a new mattress assembly for providing a more restful and supportive nights sleep.

2. Description of the Prior Art

The use of mattresses is known in the prior art. More specifically, mattresses heretofore devised and utilized are known to consist basically of familiar, expected and obvious structural configurations.

Known prior art includes U.S. Pat. No. Des. 433,861; U.S. Pat. Nos. 5,701,623; 5,226,185; 4,143,435; 5,802,646; and 4,837,879.

Mattresses are known in the crowded prior art. However, conventional mattresses typically require a box spring to support the mattress in order to provide a user a comfortable nights sleep. Various combinations of materials have been employed in the manufacture of mattresses. Conventional mattresses are often composed of either a foam core or a foam core with cotton padding positioned on a coiled spring support. The box spring that supports the mattress is generally a system of more rigid coiled springs. The disadvantages of conventional mattresses and box springs is that they tend to be bulky and the coiled springs have a tendency to fail resulting in uneven support for a user lying on the mattress. The uneven support provide an uncomfortable nights sleep for the user.

SUMMARY OF THE INVENTION

In view of the foregoing disadvantages inherent in the known types of mattresses now present in the prior art, the present invention provides a new mattress assembly construction wherein the same can be utilized for providing a more restful and supportive nights sleep.

The general purpose of the present invention, which will be described subsequently in greater detail, is to provide a new mattress assembly which has many of the advantages of the mattresses mentioned heretofore and many novel features that result in a new mattress assembly which is not anticipated, rendered obvious, suggested, or even implied by any of the prior art mattresses, either alone or in any combination thereof.

While these devices fulfill their respective, particular objectives and requirements, the aforementioned patents do not disclose a new mattress assembly. The inventive device includes a mattress core assembly and a support member that has a generally planar base having an upper surface for supporting the mattress core assembly. The mattress core assembly is positioned on the upper surface of the base.

An object of the present invention is to provide a new mattress assembly that has an increased supportive sleeping surface for increased sleeping comfort. Users with back problems often benefit from an increased supportive sleeping surface.

Another object of the present invention is to provide a new mattress assembly that is less bulky by combining a mattress and box spring into a single mattress assembly.

There has thus been outlined, rather broadly, the more important features and objects of the mattress assembly in order that the detailed description thereof that follows may be better understood, and in order that the present contribution to the art may be better appreciated.

Before explaining at least one embodiment of the invention in detail, it is to be understood that the invention is not limited in its application to the details of construction and to the arrangements of the components set forth in the following description. Additionally, the present invention is not limited to the construction illustrated in the drawings. The invention is capable of other embodiments and of being practiced in various ways. Also, it is to be understood that the phraseology and terminology employed herein are for the purpose of description and should not be regarded as limiting. Therefore, the claims should be regarded as including such equivalent constructions.

BRIEF DESCRIPTION OF THE DRAWINGS

The drawings of the preferred embodiment annexed herein include.

DESCRIPTION OF THE PREFERRED EMBODIMENT

Figure 1:
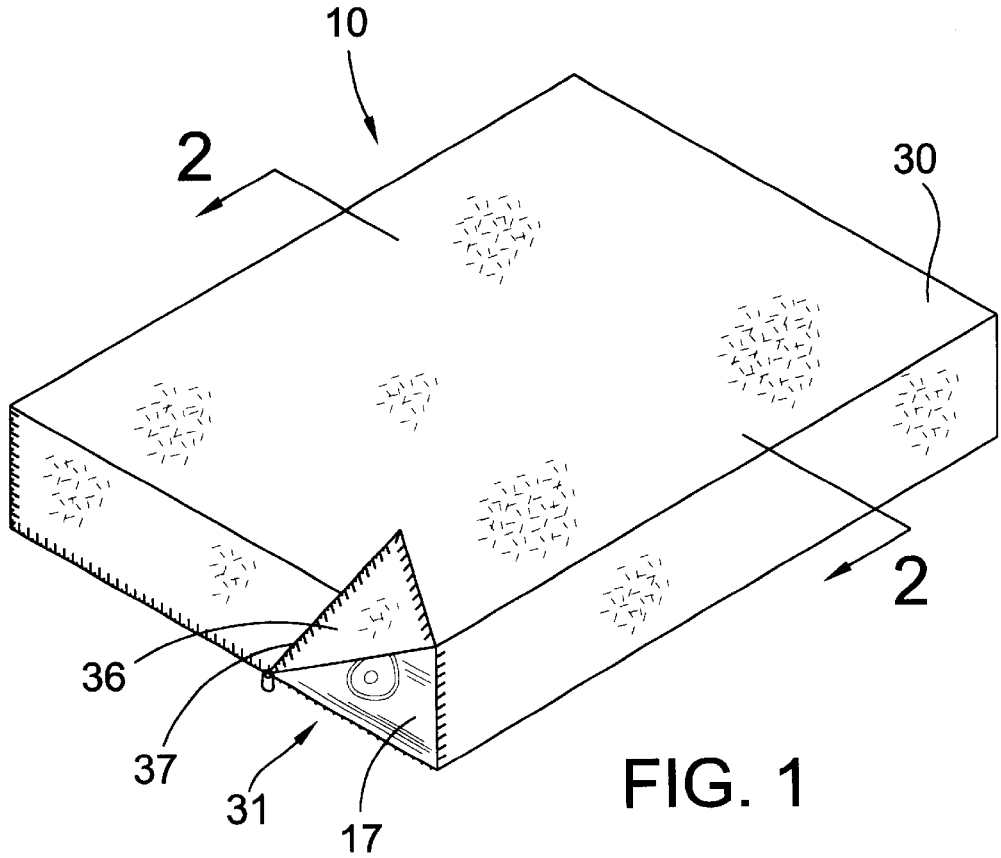
FIG. 1 is a perspective view of a new mattress assembly according to the present invention.

Referring to FIG. 1 a new mattress assembly is designated by the reference numeral 10. The mattress assembly 10 generally comprises a mattress core assembly 13 and a support member 14 for supporting the mattress core assembly 13. The support member 14 includes a generally planar base 15 that has an upper surface 16. The mattress core assembly 13 is removably positionable on the upper surface 16 of the planar base 16.

In one embodiment of the present invention, the support member 14 may include a perimeter wall 17 extending perpendicularly away from the upper surface 16 of the planar base 15. The mattress core assembly 13 is positioned on the support member 14 such that the perimeter wall extends about the mattress core assembly 13. The perimeter wall 17 reduces horizontal expansion of the mattress core assembly 13, thereby decreasing compression of the mattress core assembly 13 and increasing support for a user lying on the mattress core assembly 13. The perimeter wall 17 may have a height approximately equal to a thickness of the mattress core assembly 13.

The support member 14 may comprise a substantially rigid material such as, for example, a wood or plastic material. However, other types of materials may also be employed.

Figure 3:
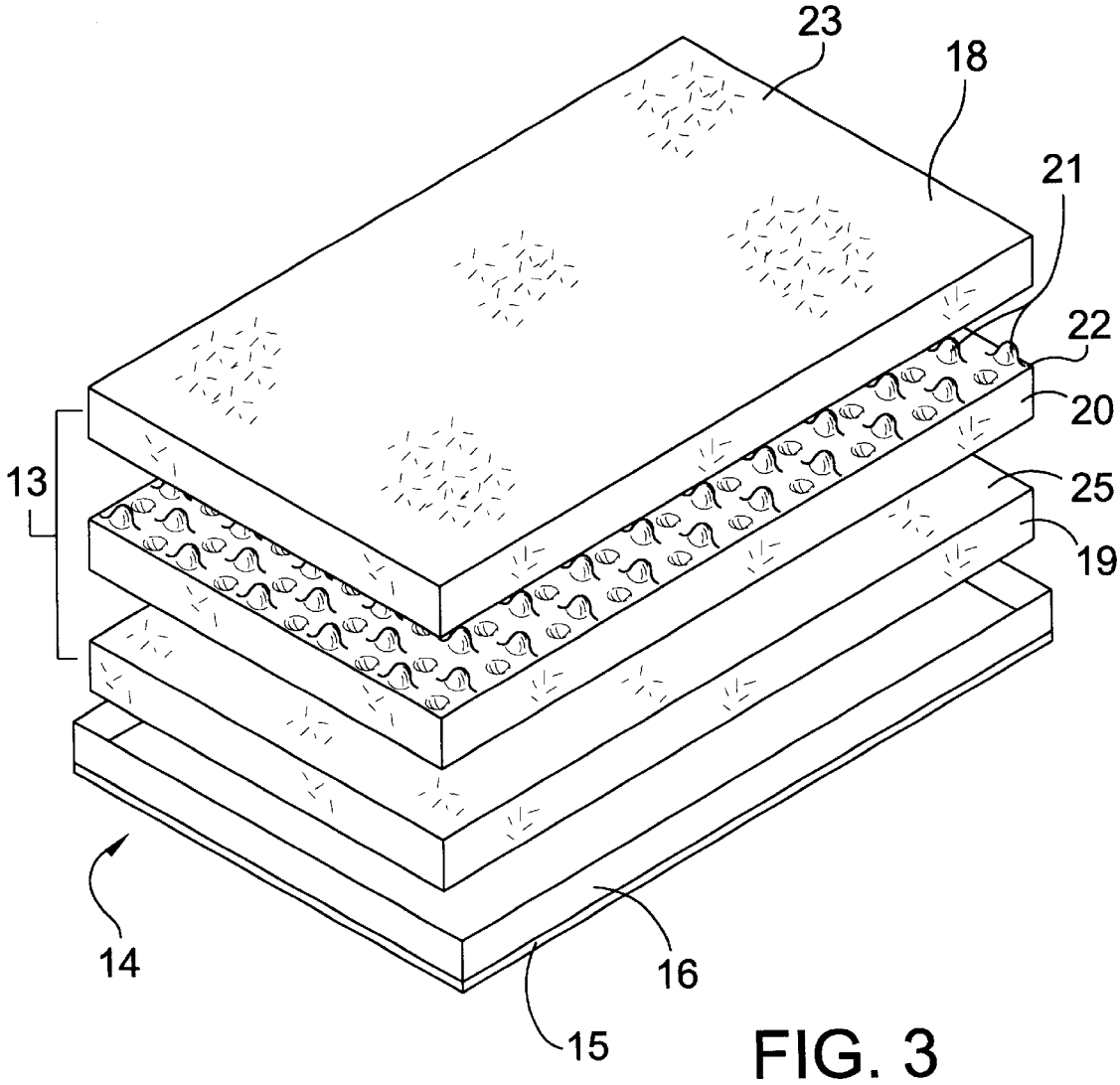
FIG. 3 is an exploded view of the present invention.

As illustrated in FIG. 3, the mattress core assembly 13 may include at least one first pad member 18 and at least one second pad member 19. At least one third pad member 20 that has a plurality of spaced protrusions 21 extending away from an upper surface 22 of the third pad member 20 may be sandwiched between the at least one first 18 and second 19 pad members.

The at least one first pad member 18 has generally planar upper 23 and lower 24 surfaces. The lower surface 24 of the at least one first pad member 18 may selectively abut the upper surface 22 of the at least one third pad member 20. The at least one first pad member 18 may comprise a resiliently compressible material such as, for example, a foam rubber material. However, other materials may be employed.

The at least one second pad member 19 has generally planar upper 25 and lower 26 surfaces. The upper surface 25 of the at least one second pad member 19 may selectively abut a lower surface 27 of the third pad member 20. The at least one second pad member 19 may comprise a resiliently compressible material such as, for example, a foam rubber material. However, other materials may be employed.

The plurality of protrusions 21 extending away from the third pad member 20 each have a terminating end. Depressions are positioned between each of the protrusions 21 creating an undulating surface. The undulating surface provides more support to the at least one pad member 18 positioned above the third pad member 20. The third pad member 20 may comprise a resiliently compressible material such as, for example, a foam rubber material. However other types of materials may also be employed.

Figure 2:
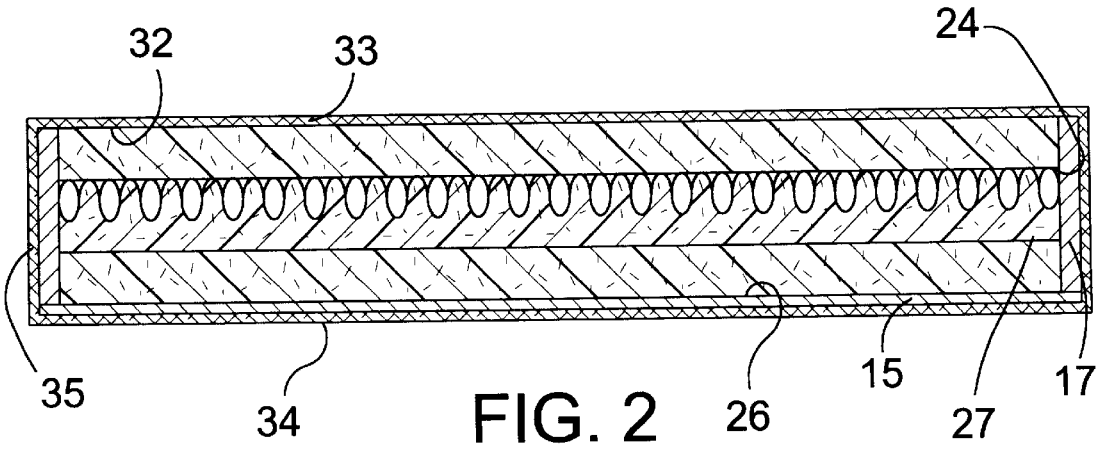
FIG. 2 is a cross sectional view of the present invention taken along line 2—2 of FIG. 1.

As illustrated in FIGS. 1 and 2, a cover member 30 that has an access opening 31 for accessing an interior 32 of the cover member may be provided. The mattress core assembly 13 and the support member 14 may be positionable in the interior 32 of the cover member 30. The cover member 30 may comprise a substantially flexible material such as, for example a cloth material. However, other types of materials may also be employed. The cover member 30 may additionally employ a plurality of patterns and colors.

In one embodiment of the present invention, the cover member 30 has first 33 and second 34 opposed panels and a perimeter panel 35 extending therebetween. A flap 36 may be mounted to the first panel 33 for selectively blocking the access opening 31 of the covering member 30.

A means of selectively coupling 37 the flap 36 to the second opposed panel 34 may be coupled to and may extend between the flap 36 and the second panel 34 for blocking the access opening 31. The means of selectively coupling 37 the flap 36 to the second opposed panel 34 may comprise a zipper that has a pair of zipper teeth portions and a zipper slide portion for coupling the pair of zipper teeth portions together.

In use, a user lies upon the upper surface 23 of the at least one first pad member 18. The weight of a user lying upon the at least one pad member 18 transfers downwardly to the third pad member 20. The plurality of protrusions 21 expands under the weight of the user. The weight of the user is also transferred to the at least one second pad member 19, which expands against the support member 14. The peripheral wall 17 prevents expansion of the at least one first 18, second 19 and the third 20 pad members causing all of the pad member 18, 19 and 20 to be less compressible and thereby more supportive.

Although the present invention has been discussed with reference to particular embodiments it will be understood that other variations and modifications to the discussed embodiments is possible without departing from the scope of the present invention.

I claim:

1. A mattress assembly for sleeping upon, said assembly comprising:

a mattress core assembly, said mattress core assembly including:

a first pad member;

a second pad member;

a third pad member having a plurality of protrusions extending away from at least an upper surface of said third pad member, said third pad member being sandwiched between said first and second, said first pad member has generally planar upper and lower surfaces, said lower surface of said first pad member selectively abutting said upper surface of said third pad member, wherein each of said pad members are of unitary construction with unvarying support characteristics therethrough; and a rigid support member having a generally planar base for supporting said mattress core assembly and a perimeter wall extending away from said planar base and positioned about and in contact with said mattress core assembly for reducing horizontal expansion of said mattress core assembly thereby decreasing compression of said mattress core assembly.

* * * * *